US005575673A

United States Patent [19]

Dahlem et al.

[11] Patent Number: 5,575,673

[45] Date of Patent: Nov. 19, 1996

[54] POLARIZING AND/OR FLOATING PANEL MOUNT FOR ELECTRICAL CONNECTORS

[75] Inventors: Charles M. Dahlem, Carol Stream; Paul Murphy, Naperville; Joseph W. Nelligan, Jr., LaGrange Park; Paul A. Reisdorf, LaGrange; Stephen A. Sampson, Downers Grove, all of Ill.

[73] Assignee: Molex Incorporated, Lisle, Ill.

[21] Appl. No.: 374,080

[22] Filed: Jan. 19, 1995

Related U.S. Application Data

[63] Continuation-in-part of Ser. No. 279,033, Jul. 22, 1994, Pat. No. 5,514,000.

[51] Int. Cl.[6] ..... H01R 13/74

[52] U.S. Cl. ..... 439/248; 439/557

[58] Field of Search ..... 439/247, 248, 439/557, 558, 680, 545

[56] References Cited

U.S. PATENT DOCUMENTS 4,664,456 5/1987 Blair et al. ..... 339/14 P
4,820,180 4/1989 Mosquera et al. ..... 439/248
5,302,134 4/1994 Thomas et al. ..... 439/247
5,362,261 11/1994 Puerner ..... 439/752

*Primary Examiner*—Gary F. Paumen
*Attorney, Agent, or Firm*—A. A. Tirva

[57] ABSTRACT

A panel mount system includes an electrical connector for mounting in an aperture in a panel. The connector has a mounting flange for interfacing with the panel, and a pair of cantilevered latch structures. Each latch structure includes a base arm projecting from the mounting flange and one locking arm deflectably cantilevered at one side of the base arm from an end thereof remote from the mounting flange. The locking arm extends angularly from the end of the base arm and from the one side thereof back towards the mounting flange. The other side of the base arm opposite the locking arm is substantially rigid. The maximum cross-sectional dimensions of one of the latch structures and its adjacent portion of the mounting aperture is different from the maximum cross-sectional dimensions of the other latch structure and its adjacent portion of the mounting aperture to provide polarization for the connector relative to the panel. The cross-sectional dimensions of the base arm adjacent the mounting flange is less than the adjacent portion of the mounting aperture to provide floating of the connector within the aperture relative to the panel.

12 Claims, 9 Drawing Sheets

22
26
24
20
16
44
58
46
52
56
34
12
40
40a
42a
50
54
42a
48
42
34
56
38
36
42a
14
40a
42
42a
58
42
48
52
10
56
54
60
58
46
44
56
50
18
32
30
28

POLARIZING AND/OR FLOATING PANEL MOUNT FOR ELECTRICAL CONNECTORS

RELATED APPLICATION

This is a continuation-in-part of application Ser. No. 08/279,033, filed Jul. 22, 1994, now U.S. Pat. No. 5,514,000 issued May 7, 1996, and assigned to the assignee of the present invention.

FIELD OF THE INVENTION

This invention generally relates to the art of electrical connectors and, particularly, to a panel mounted electrical connector system which provides for polarization of the connector relative to the panel and also may provide for floating of the connector in the panel.

BACKGROUND OF THE INVENTION

Electrical connector assemblies typically include opposed mateable electrical connector halves, each of which have a dielectric housing mounting a plurality of electrical terminals securely therein. Electrical conductors or wire leads may be terminated to the terminals mounted in the housing, or the housing may mate with still other connectors, such as drawer connectors, including a pair of panel mounted connector halves which are mateable with one another by movement of at least one of the panels toward the other.

The dielectric housings of drawer connectors typically are molded from a suitable plastic material and preferably define a unitary or one-piece molded plastic structure. The opposed housings normally include appropriate guide structure for guiding the two mateable connector halves into a mated electrical connection. However, to facilitate initial mechanical alignment of the connector housings, at least one connector half is provided with a floating mount relative to its respective panel. Various types of floating panel mounts for electrical connectors have been provided in the art. One such floating panel mount is shown in U.S. Pat. No. 4,820,180 to Mosquera et al, dated Apr. 11, 1989 and assigned to the assignee of this invention, and which is incorporated herein by reference.

In addition, certain applications may require that a panel mounted electrical connector be polarized relative to the panel in which it is mounted. In other words, it may be required that the connector have a particular orientation relative to its panel. Therefore, additional structure is required to provide for such polarization.

Still further, many connector halves of a panel mounted electrical connector system are provided as different male and female electrical connector halves. This requires two different structures, particularly two distinct dielectric housing configurations for the pair of panel mounted connectors. It would be desirable to provide a hermaphroditic connector system wherein the pair of panel mounted connector halves are identical in construction yet providing all of the other features of a desirable floating panel mount system, such as polarization of the connectors and floating of at least one of the connectors relative to its panel. This invention is directed to providing such an efficient system.

SUMMARY OF THE INVENTION

An object, therefore, of the invention is to provide a new and improved panel mount system for electrical connectors, of the character described.

In the exemplary embodiment of the invention, the features of the invention are embodied in a pair of drawer connectors which are mounted in mounting apertures of respective panels. The connectors are hermaphroditic, and at least one of the connectors is mounted in its respective panel by a floating panel mount system.

As disclosed herein, each hermaphroditic electrical connector includes a mounting flange for interfacing with the panel. A mounting portion projects from the flange and through the mounting aperture in the respective panel. A pair of cantilevered latch structures also project from the mounting flange. Each latch structure includes base arm means projecting from the mounting flange and one locking arm deflectably cantilevered at one side of the base arm means from an end of the base arm means remote from the mounting flange. The locking arm extends angularly from the end of the base arm means and from the one side thereof back toward the mounting flange. The other side of the base arms means opposite the locking arm is substantially rigid.

In providing polarization of the connectors relative to their panels, the maximum cross-sectional dimensions of one of the latch structures and its adjacent portion of the mounting aperture is different from the maximum cross-sectional dimensions of the other latch structure and its adjacent portion of the mounting aperture. Therefore, the connector can be inserted into its respective mounting aperture only when the differently dimensioned latch structures are aligned with their different portions of the mounting aperture.

In providing a floating panel mount system, the maximum cross-sectional dimension of the locking arm is greater than the adjacent portion of the mounting aperture, and the cross-sectional dimension defined by the base arm means is less than the adjacent portion of the mounting aperture. Therefore, the locking arm is deflectable to pass through the mounting aperture and then to an undeflected condition to mount the connector to the panel, and the dimensions of the base arm means permit floating of the connector relative to the panel.

As disclosed herein, the base arm means of the one latch structure includes a single base arm with the locking arm thereof being cantilevered therefrom, and a substantially rigid post is spaced from the base arm at the one end of the base arm means. The base arm means of the other latch structure includes a single substantially rigid base arm with the locking arm thereof being cantilevered integrally therefrom.

Generally, another feature of the invention comprises a guide post projecting from the mounting flange for guiding into a generally rectangular guide receptacle of a complementary connector. The guide post is X-shaped in cross-section defining intersecting legs, with side edges of the legs being adapted for insertion into corners of the rectangular guide receptacle. The intersecting legs of the X-shaped guide post have end edges which taper to an apex at the distal end of the post.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
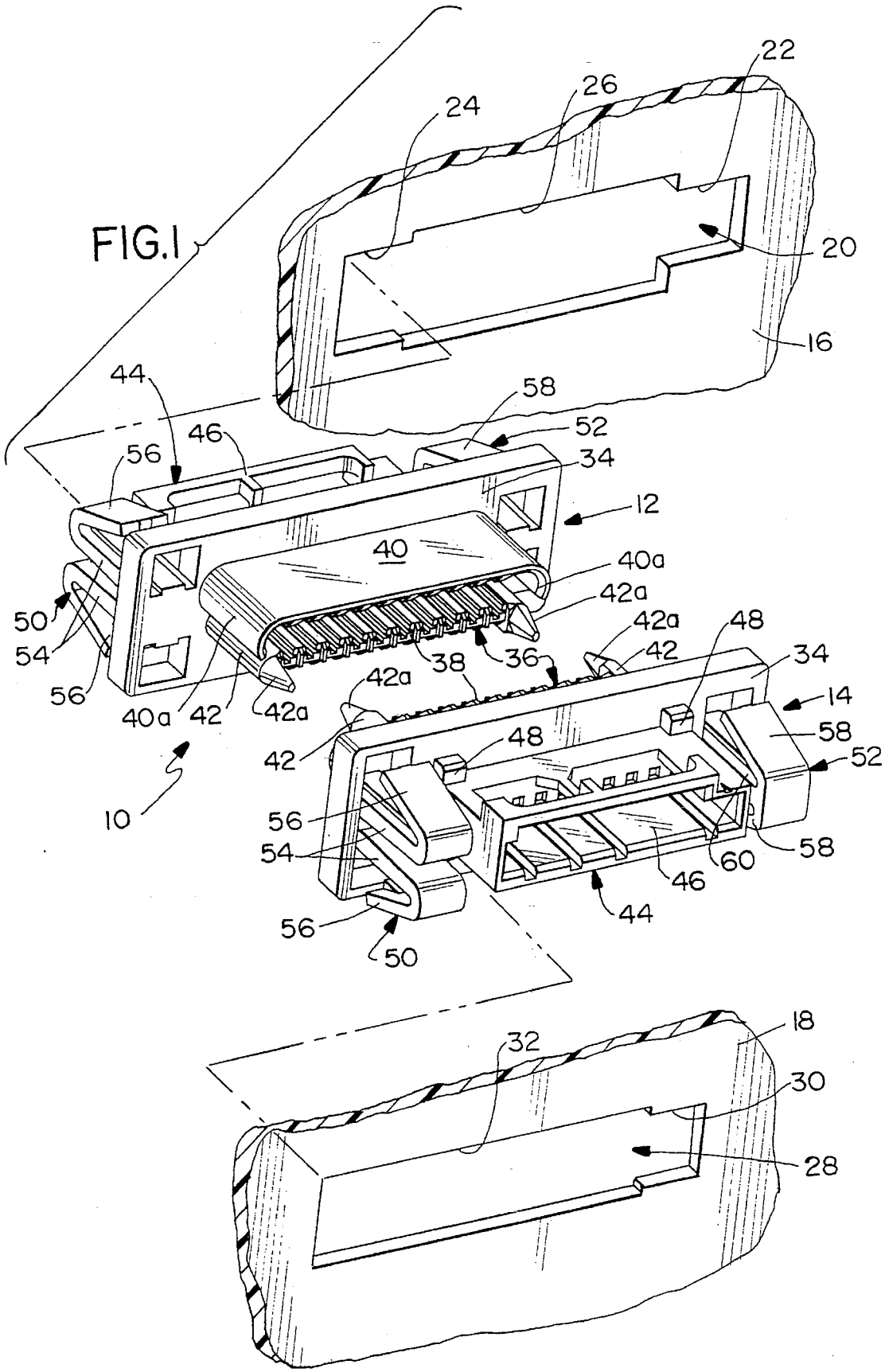
FIG. 1 is an exploded perspective view of the first embodiment of the electrical connector panel mount system of the invention.

Referring to the drawings in greater detail, and first to FIG. 1, one embodiment of the invention is incorporated in a panel mount system, generally designated 10, of the drawer type which includes a pair of electrical connectors, generally designated 12 and 14, which are mounted in panels 16 and 18, respectively. The connectors are mateable with one another by movement of at least one of the panels toward the other. Therefore, since the panels (i.e. the connectors) may not be in precise alignment, a floating panel mount system is provided for at least one of the connectors, as described hereinafter. Still further, connectors 12 and 14 are hermaphroditic and, therefore, only one of the connectors, separate from its respective panel, will be described hereinafter.

Before proceeding with a detailed description of one of connectors 12 and 14, and still referring to FIG. 1, panel 16 has an elongated mounting aperture, generally designated 20, for mounting connector 12 therewithin. Aperture 20 includes a mounting portion 22 at one end and a mounting portion 24 at the opposite end. For polarization purposes described hereinafter, mounting portion 22 of elongated aperture 20 is smaller or narrower than mounting portion 24 at the opposite end of the elongated aperture. An enlarged aperture portion 26 extends between end mounting portions 22 and 24 and is larger or wider than either of the end mounting portions, for providing floating of connector 12 therewithin as will be seen hereinafter.

Panel 18 includes a mounting aperture, generally designated 28, for mounting connector 14 therewithin. Aperture 28 includes an end mounting portion 30 which is narrower than a remaining aperture portion 32 which forms the remainder of the mounting aperture. This configuration provides for polarization of connector 14 within panel 18 but does not provide for floating of the connector relative to the panel.

Figure 2:
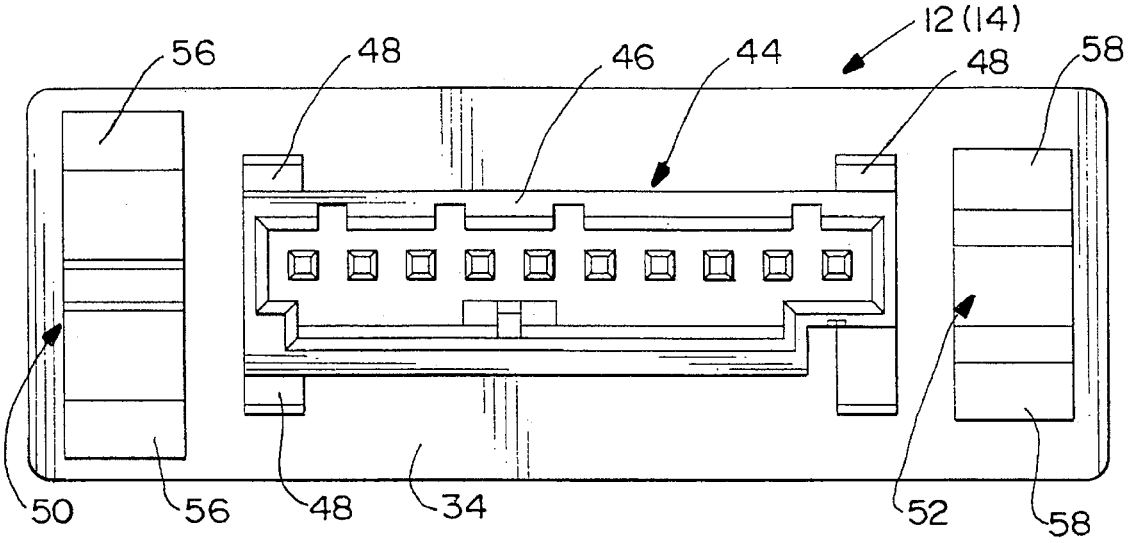
FIG. 2 is an elevational view of the panel mounting end of one of the connectors.
Figure 3:
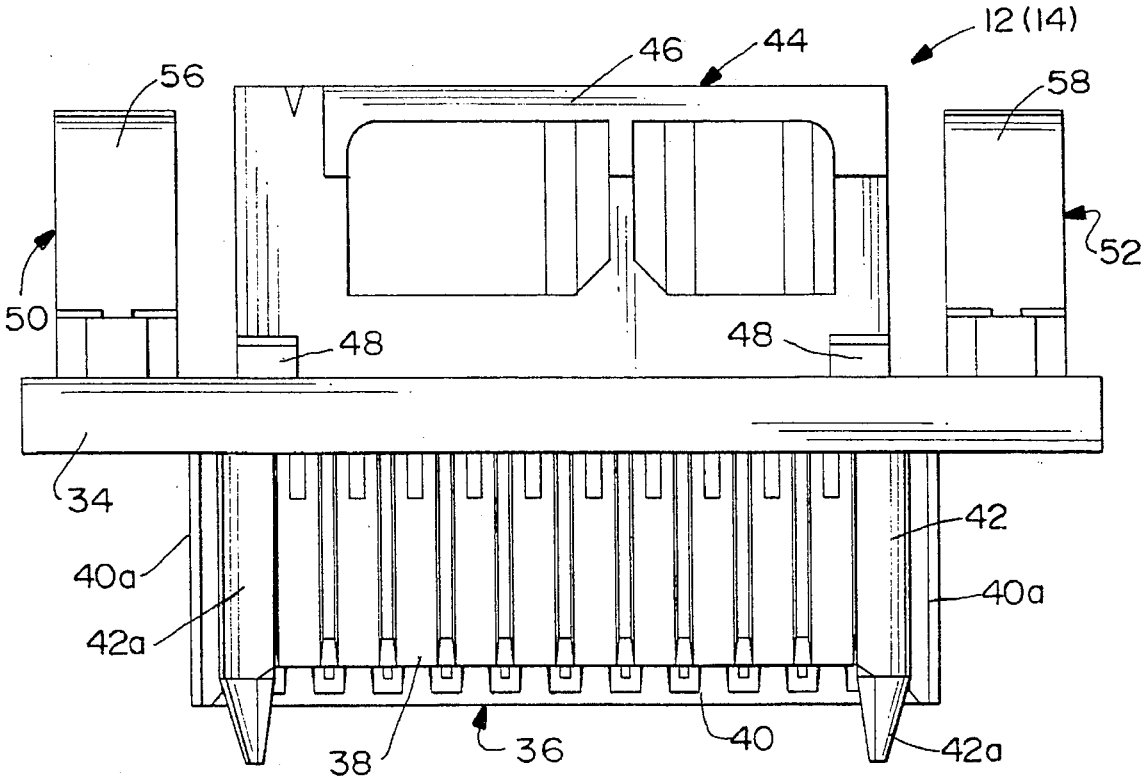
FIG. 3 is a side elevational view of one of the connectors.
Figure 4:
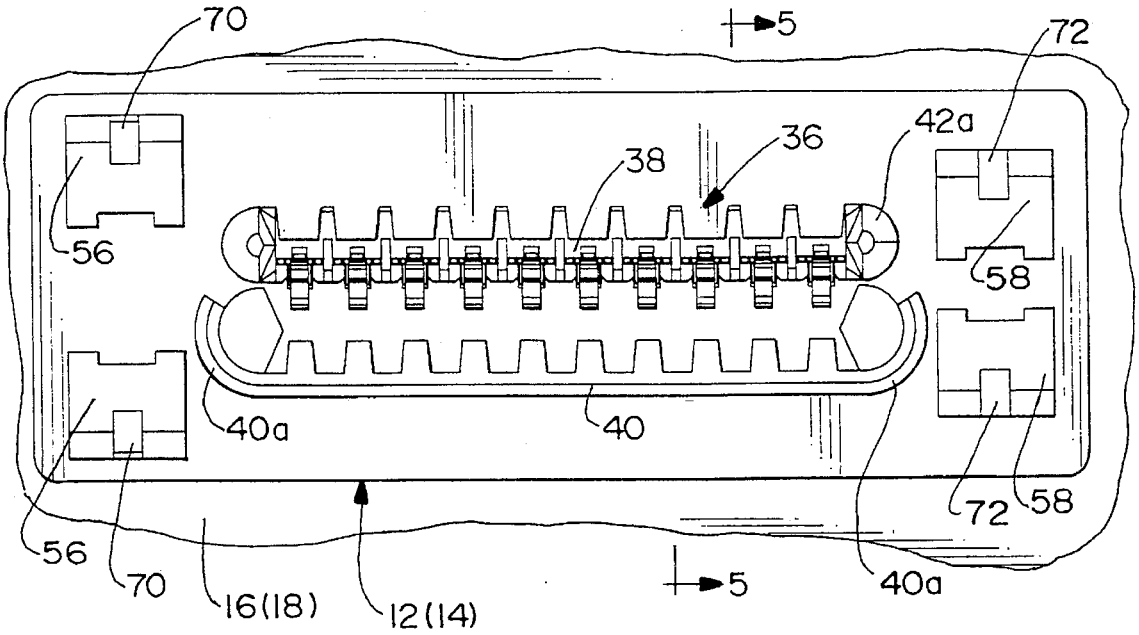
FIG. 4 is an elevational view of the mating end of one of the connectors and its panel.

Referring to FIGS. 2–4 in conjunction with FIG. 1, connectors 12 and 14 now will be described. However, since the connectors are hermaphroditic and, therefore, identical in construction, like numerals are being applied to like components or portions of the two connectors.

More particularly, each connector includes a mounting flange 34 for interfacing with or abutting against the respective panel 16 or 18. A mating portion, generally designated 36, projects from flange 34 for mating with the mating portion of the other connector. In particular, a plurality of terminals (described hereinafter in relation to FIG. 5) are mounted on a wall 38, with the terminals being protected by a shroud 40 having rounded ends 40*a*. A pair of posts 42 project from flange 34 for insertion into the rounded ends 40*a* of shroud 40 of the other connector. The ends of the posts are tapered, as at 42*a*, to facilitate insertion of the posts into the rounded ends of the shroud of the other connector. When the connectors are mated, the terminals on the insides of walls 38 of the connectors, protected by shrouds 40, are interengaged in mated condition.

Each connector also includes a mounting end, generally designated 44, which includes a box-like integral housing 46 that surrounds pin portions of the terminals (as described hereinafter in relation to FIG. 5). The box-like housing 46 projects from mounting flange 34 on the opposite side of the flange from which mating portion 36 extends. Abutment bosses 48 are formed at the base of housing 46, at the four corners of the housing as best seen in FIG. 2, for purposes described hereinafter.

Each connector 12 and 14 also includes a pair of cantilevered latch structures, generally designated 50 and 52, projecting from flange 34 at opposite ends of housing 46 at mounting end 44 of the connector. As seen best in FIG. 1, each cantilevered latch structure 50 includes base arm means in the form of a pair of base arms 54 projecting from mounting flange 34. A pair of locking arms 56 are deflectably cantilevered from the ends of base arms 54 remote from flange 34 such that the locking arms extend angularly from the ends of the base arms and from opposite sides thereof back toward mounting flange 34, as is clearly seen at the left-hand ends of connectors 12 and 14 in FIG. 1.

Cantilevered latch structure 52 is very similar to latch structure 50 in that a pair of locking arms 58 are deflectably cantilevered from an end of a base arm means 60 remote from mounting flange 34 such that the locking arms extend angularly from the end of the base arm means and from opposite sides thereof back toward the mounting flange. In comparing latch structure 52 with latch structure 50, latch structure 52 has a single base arm 60 versus the two base arms 54 of latch structure 50.

The entire housing for either of connectors 12 and 14, including flange 34, mating end 36, mounting end 44 and latch structures 50 and 52 is unitarily molded in one-piece of dielectric material such as plastic or the like.

As stated above, panel mount system 10 includes means for polarizing connectors 12 and 14 relative to their respective panels 16 and 18. More particularly, the maximum cross-sectional dimension of each latch structure 50 and 52 is defined by each pair of locking arms 56 or 58 of the latch structure. In other words, the maximum cross-sectional dimension of either latch structure is defined by the peripheral dimension about the free tips of the locking arms.

Referring to FIG. 2 in conjunction with FIG. 1, it clearly can be seen that the maximum cross-dimension of latch structure 50, as defined by locking arms 56, is greater than the maximum cross-sectional dimension of latch structure 52 as defined by locking arms 58. Correspondingly, mounting portion 24 (FIG. 1) of mounting aperture 20 is larger than mounting portion 22 of the mounting aperture, and aperture portion 32 of mounting aperture 28 also is larger than mounting portion 30 of aperture 28. As seen in FIG. 1, larger latch structure 50 of connector 12 is alignable with larger mounting portion 24 of mounting aperture 20 in panel 16, and larger latch structure 50 of connector 14 is alignable with the end of aperture portion 32 of mounting aperture 28 in panel 18. Similarly, smaller latch structure 52 is alignable with smaller mounting portion 22 of mounting aperture 20 in panel 16, and smaller latch structure 52 of connector 14 is alignable with smaller mounting portion 30 of aperture 28 in panel 18. With this structural arrangement, connector 12 can be inserted into mounting aperture 20 of panel 16 only in the orientation shown in FIG. 1, and connector 14 can be inserted into mounting aperture 28 in panel 18 only in the orientation shown.

As stated above, panel mount system 10 includes a floating panel mount system for at least one of connectors 12 and 14. In the embodiment illustrated, connector 12 is provided with a floating panel mount system relative to panel 16. In particular, enlarged aperture portion 26 in panel 16 is larger than the adjacent inserted portions (i.e. bosses 48) of connector 12. This is shown particularly in FIG. 5 wherein it can be seen that bosses 48 are spaced inwardly of enlarged aperture portion 26. This allows connector 12 to float within the aperture in the direction of double-headed arrow "A". To that end, it should be understood that the maximum cross-sectional dimension of the pair of base arms 54 of latch structure 50 as well as the maximum cross-sectional dimension of single base arm 60 of latch structure 52 are less than their respective adjacent portions of the mounting apertures so that connector 12 can float within mounting aperture 20 relative to panel 16.

Figure 5:
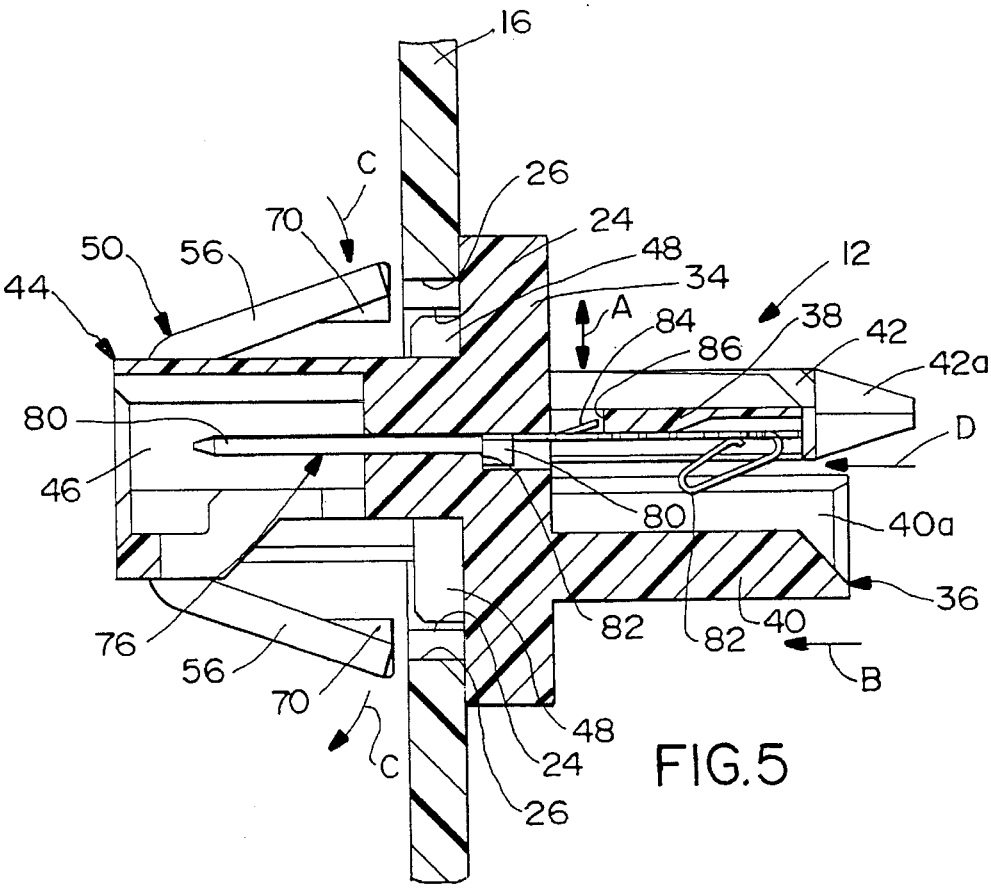
FIG. 5 is a vertical section taken generally along line 5—5 of FIG. 4.
Figure 6A:
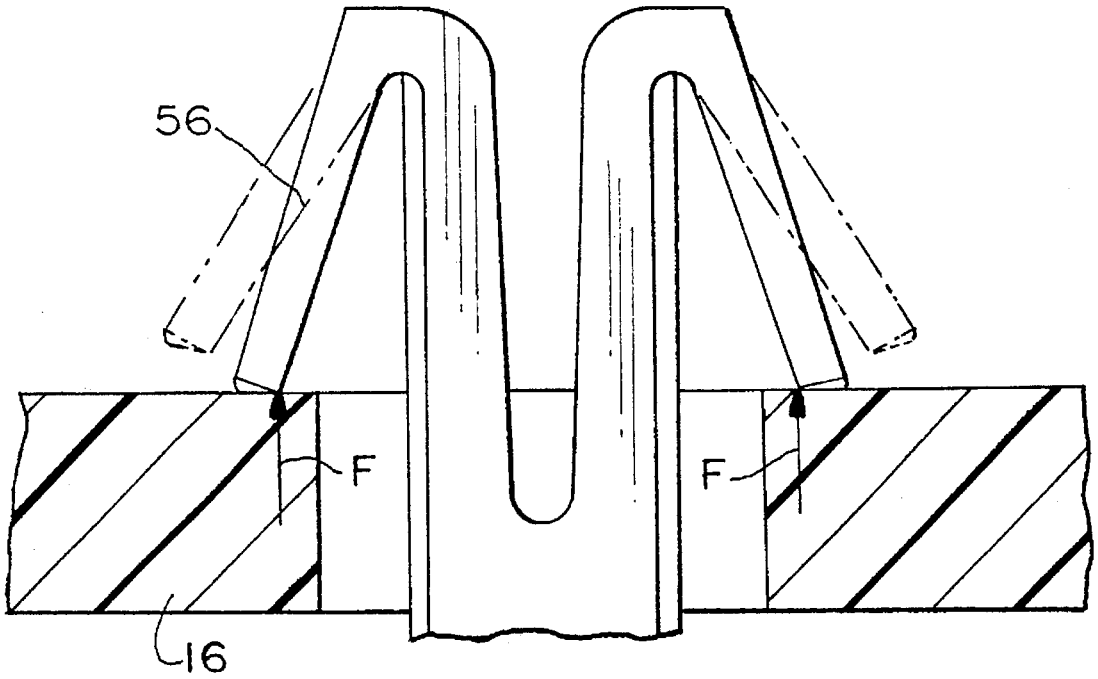
FIG. 6A (PRIOR ART)
FIGS. 6A and 6B illustrate forces acting on locking arms of a prior art and first embodiment connector, respectively.
Figure 6B:
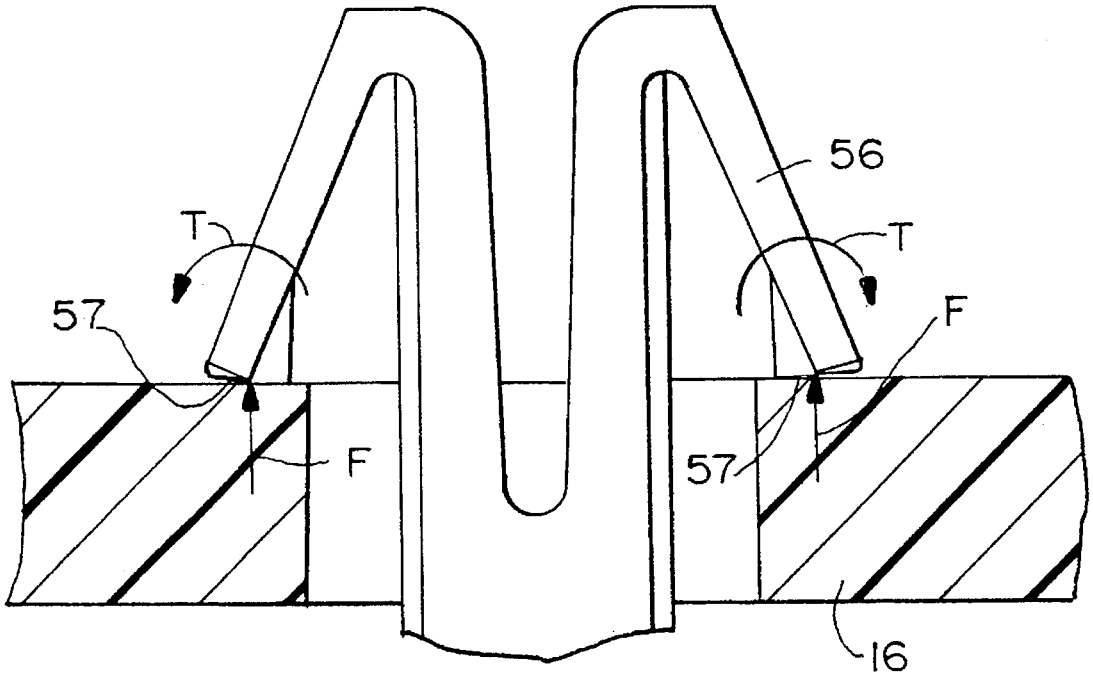

Another feature of the invention is shown best in FIG. 5 and, generally, comprises anti-overstress means between locking arms 56 and the base arms of latch structure 50. More particularly, a beam-like boss 70 is molded integrally with the inside of each locking arm 56. These bosses prevent the locking arms from being bent too far inwardly toward the base arm means of the latch structure. In addition, the bosses are beam-like as shown in FIG. 5 and perform a dual function of providing stability for locking arms 56 as well as providing the anti-overstress means. Stabilizing is required under load condition during unmating of connectors and is achieved by the anti-overstress boss 70 by converting an axial force "F" exerted by panel 16 into a torsional force "T" which is counteracted by the increased footprint 57 of the lockings arms 56. The effect of force "F" on one of the locking arms 56 without and with over-stress boss 70 is shown in FIGS. 6*a* and 6*b*, respectively. FIG. 4 shows that locking arms 58 of latch structure 52 (FIG. 1) also have beam-like bosses 72 for stabilizing the locking arms and providing an anti-overstress means therefor.

Referring to FIG. 5, connector 12 is inserted into the mounting aperture in panel 16 in the direction of arrow "B". The maximum cross-sectional dimension defined by locking arms 56 is such as to allow the locking arms to deflect inwardly in the direction of arrows "C" to pass through the mounting aperture and then back to an undeflected condition as shown in FIG. 5 to mount connector 12 to panel 16. The same structural/functional relationship exists for locking arms 58 of latch structure 52. The maximum cross-sectional dimension of base legs 54 of latch structure 50 or base leg 60 of latch structure 52 is such as to permit floating of connector 12 relative to panel 16. Bosses 48 also allow for floating of the connector relative to the panel, as described above.

Referring back to FIG. 1, connector 14 is not provided with a floating panel mount system relative to panel 18. This can be understood by comparing the configuration of mounting aperture 28 in panel 18 with mounting aperture 20 in panel 16. It can be seen that mounting aperture 28 does not have an enlarged aperture portion similar to enlarged aperture portion 26 of mounting aperture 20. Therefore, bosses 48 of connector 14 abut against the longitudinal sides of aperture portion 32 of aperture 28, and connector 14 cannot float within aperture 28 relative to panel 18. Of course, if it is desirable to provide a floating panel mount system for both connectors 12 and 14, the configuration of mounting aperture 28 in panel 18 simply would be made the same as the configuration of mounting aperture 20 in panel 16.

Lastly, referring back to FIG. 5, it can be seen that one of the plurality of terminals, generally designated 76, is shown mounted within connector 12. 0f course, there are a plurality of such terminals mounted within the connector spaced lengthwise thereof. Connector 14 has a similar array of terminals mounted securely therewithin. The terminals are inserted into the connector in the direction of arrow "D" until a latching tongue 84 of the terminal resiliently latches against a locking shoulder 86 of the connector. A terminal pin 88 projects into boxlike housing 46, and a folded over contact portion 82 of the terminal projects laterally toward shroud 40 at the mating end of the connector. The terminals within connector 14 are identical to terminals 76 within connector 12. Therefore, when the two connectors are mated, folded-over contact portions 82 of the terminals within the respective connectors are biasingly engaged with each other.

FIGS. 7–13 show a second embodiment of the invention which is incorporated in a panel mount system, generally designated 92, of the drawer type which includes a pair of electrical connectors, generally designated 94 and 96, that are mounted in panels 16 and 18 (see FIG. 1), respectively. The panels are not shown in FIG. 7 but reference can be made to FIG. 1 for the configurations thereof. Again, since the panels (i.e. the connectors) may not be in precise alignment, a floating panel mount system is provided for at least one of the connectors 94 and/or 96. Both connectors and their respective panels also are provided with a polarization system similar to that described above. Still further, connectors 94 and 96, again, are hermaphroditic and, therefore, only one of the connectors, separate from its respective panel, will be described hereinafter.

Figure 7:
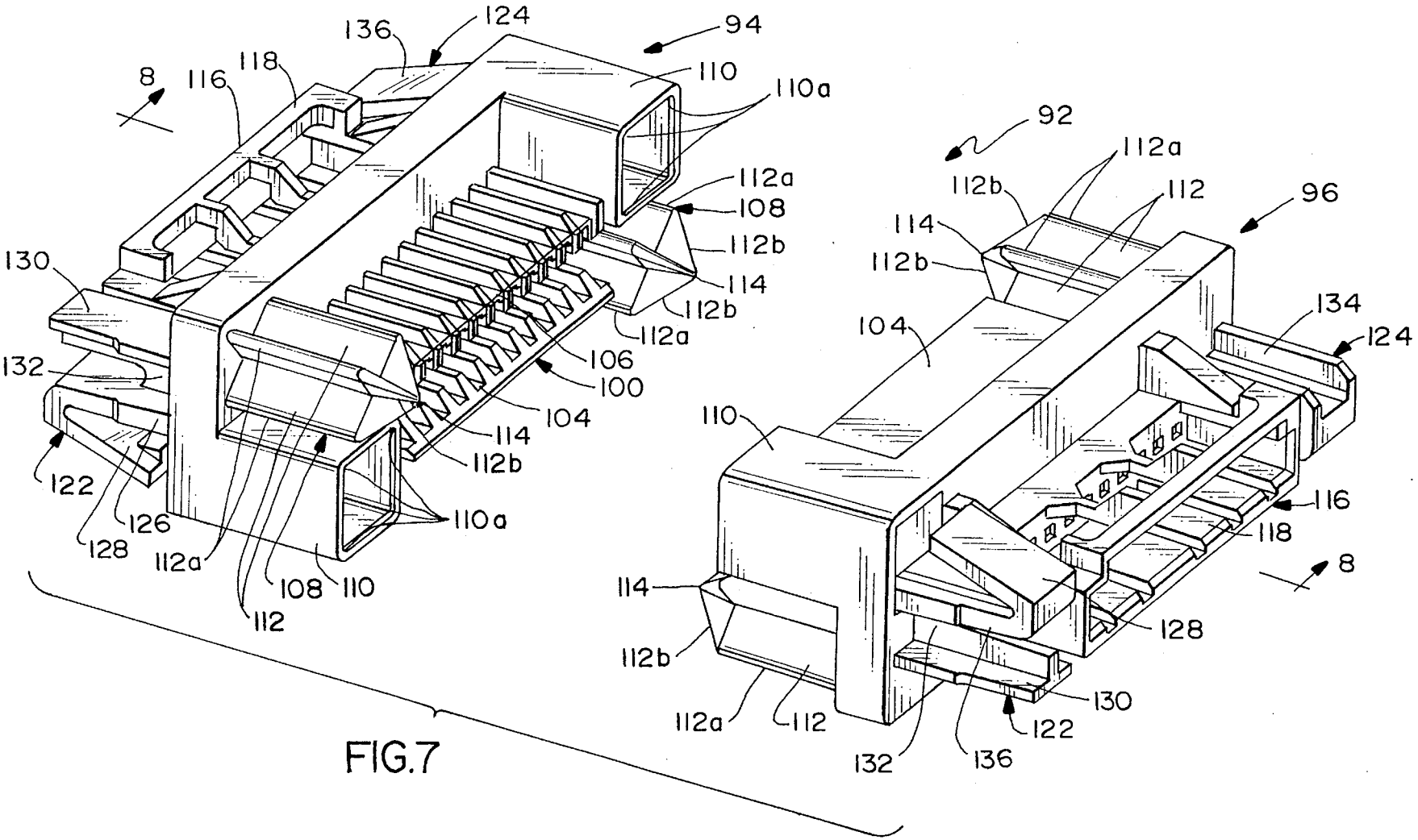
FIG. 7 is an exploded perspective view of a second embodiment of the electrical connector panel mount system of the invention.
Figure 8:
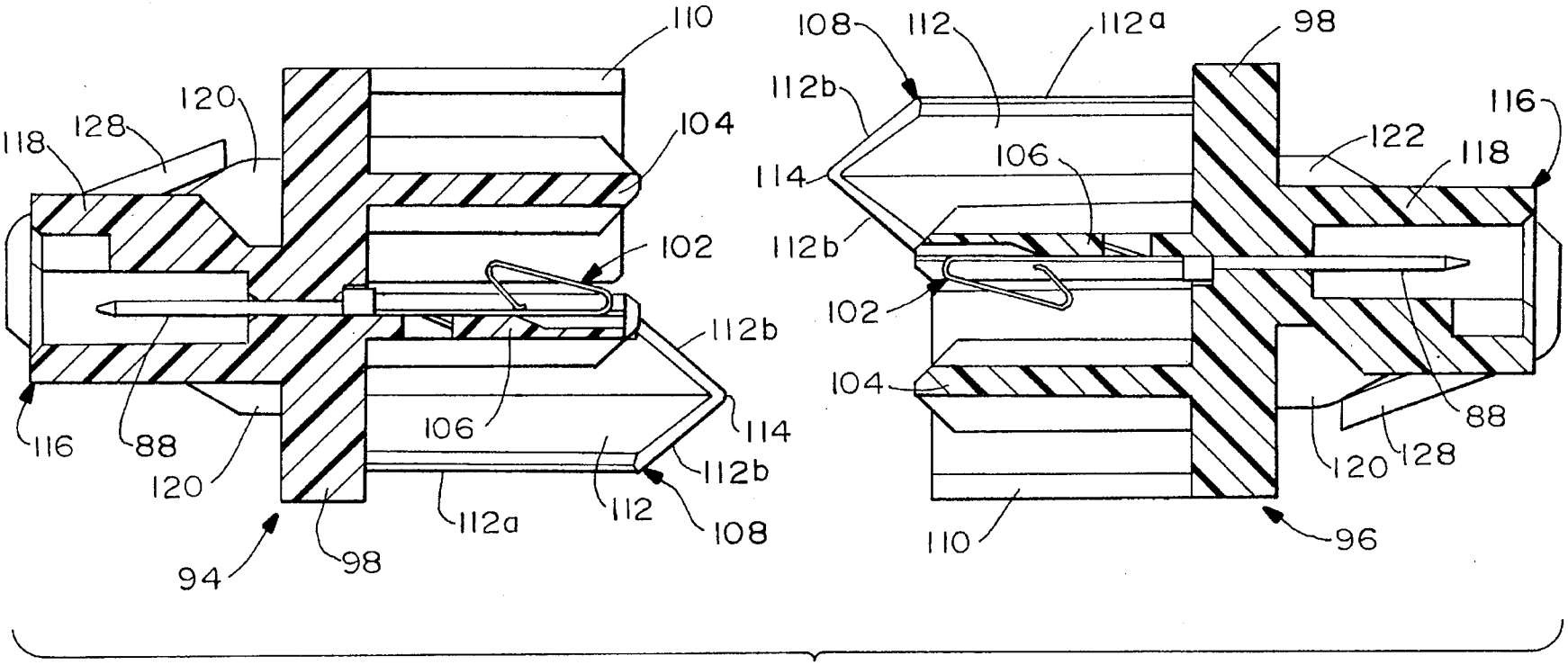
FIG. 8 is a section taken generally along line 8—8 of FIG. 7.
Figure 9:
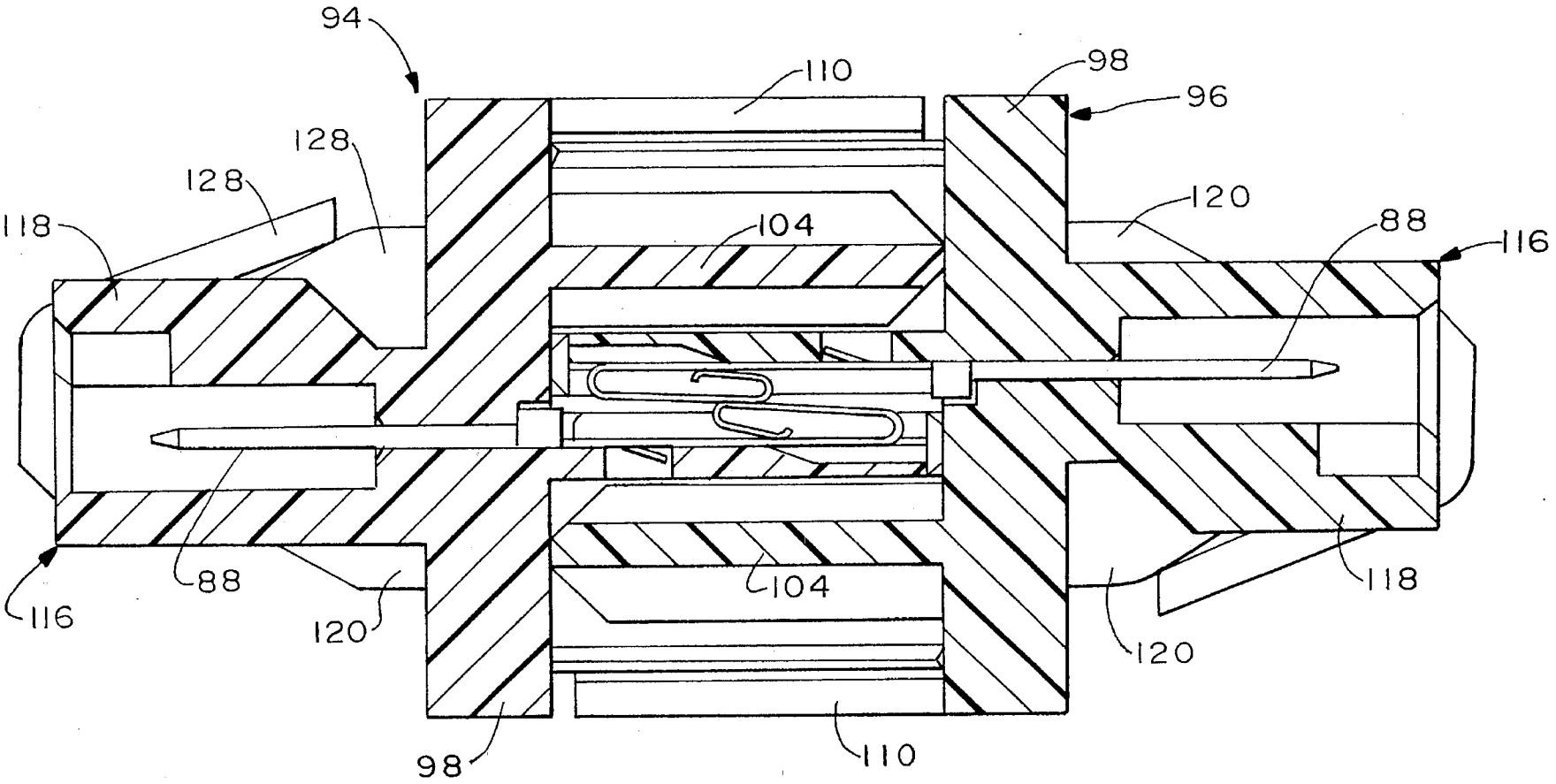
FIG. 9 is a view of the connectors in FIG. 8 in fully mated condition.
Figure 10:
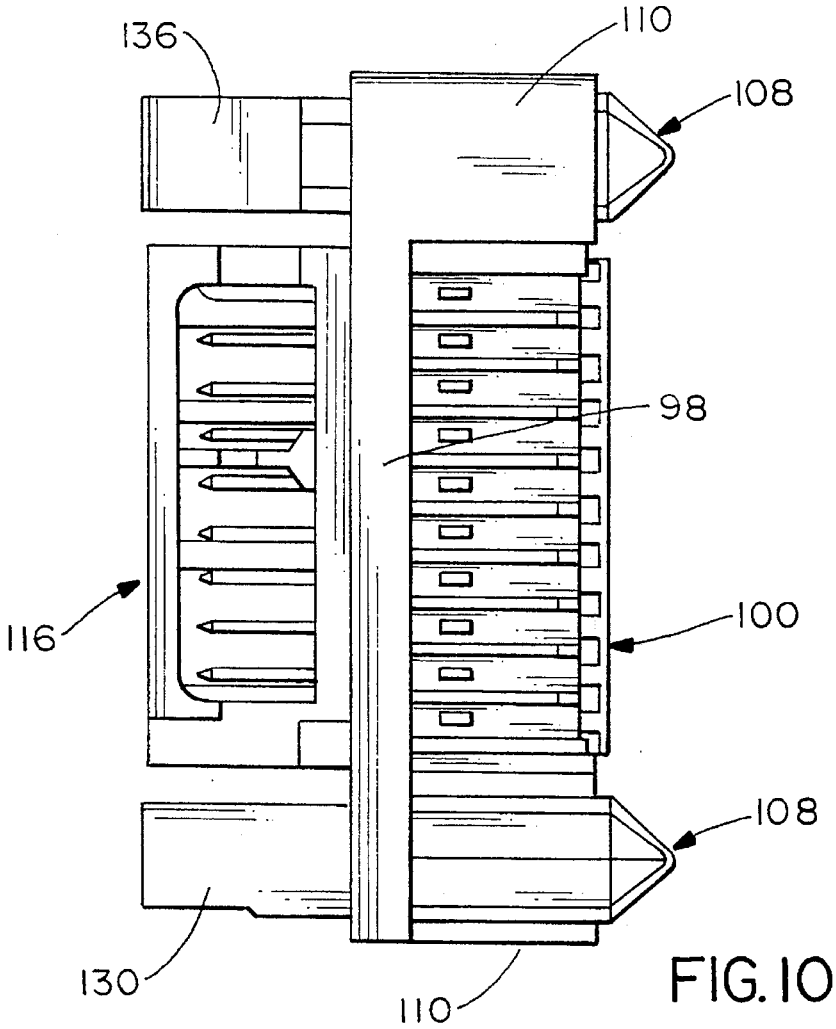
FIG. 10 is a top plan view of one of the connectors.
Figure 11:
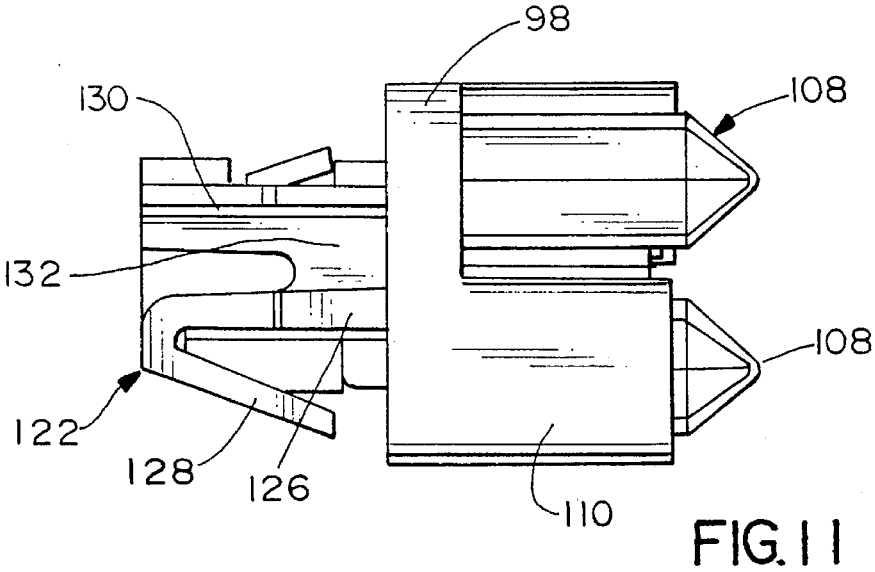
FIG. 11 is an end elevational view of the connector in FIG. 10.
Figure 12:
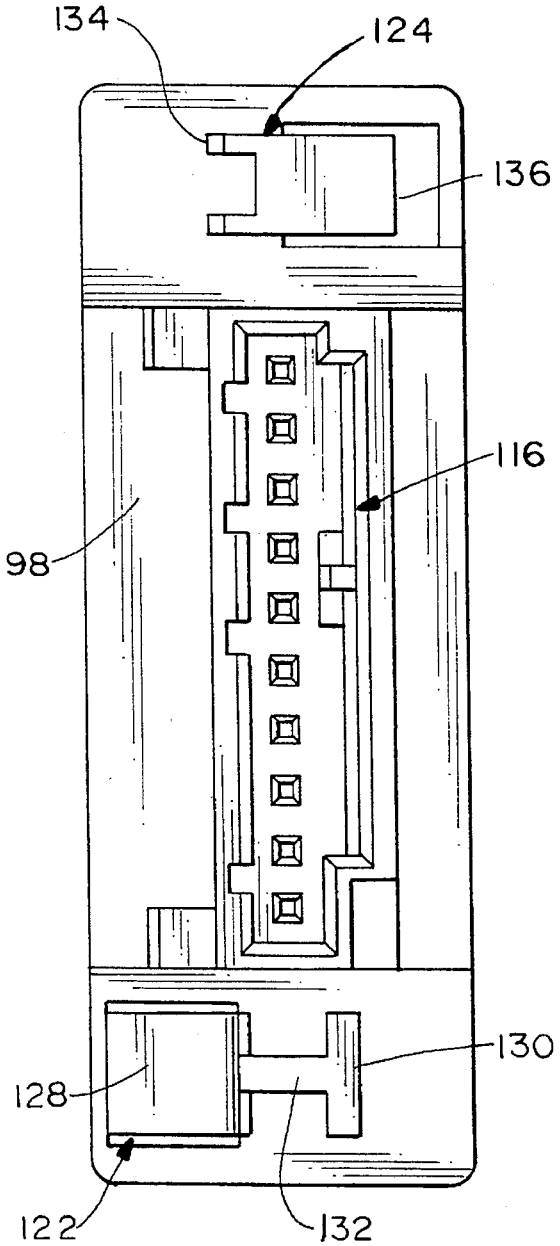
FIG. 12 is a side elevational view looking toward the left-hand side of FIG. 10.
Figure 13:
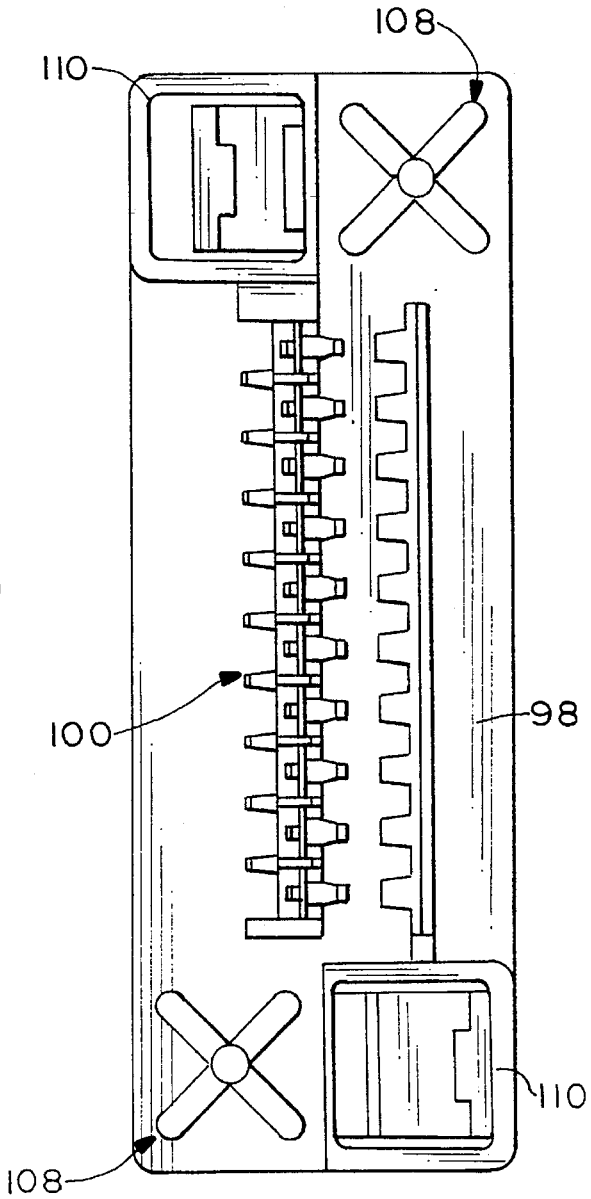
FIG. 13 is a side elevational view looking toward the right-hand of FIG. 10.

Referring to FIG. 8 in conjunction with FIG. 7, each connector includes a mounting flange 98 for interfacing with or abutting against the respective panel 16 or 18. A mating portion, generally designated 100, projects from flange 98 for mating with the mating portion of the other connector. A plurality of terminals, generally designated 102 (FIG. 8), are mounted on a wall 104, with the terminals being protected by a second wall 106 extending generally parallel to wall 104. A pair of guide posts, generally designated 108, projects from flange 98 for insertion into generally rectangular guide receptacles 110 of the other connector. Each guide post is generally X-shaped in cross-section defining intersecting legs 112. Side edges 112*a* of the legs are adapted for insertion into the corners 110*a* of the rectangular guide receptacles. The intersecting legs have end edges 112*b* which taper to an apex 114 at the distal end of each guide post 108. When the connectors are mated, the sizable tapered ends of the guide posts provide a wide range of lost-motion between the connectors during mating as the connectors float within their respective panels. There is one guide post 108 and one guide receptacle 110 at each opposite end of each connector. This redundancy allows for guided mating of the connectors even in the event that one of the posts or one of the receptacles at any one end of either connector becomes broken.

Each connector also includes a mounting end, generally designated 116, which includes a box-like integral housing 118 that surrounds pin portions 88 of terminals 102. Since terminals 102 are identical to terminals 76 (FIG. 5), like numerals have been applied in FIGS. 8 and 9 corresponding to like portions of terminals 102 as described above in relation to terminal 76 in FIG. 5. The box-like housing 118 projects from mounting flange 98 on the opposite side of the flange from which mating portion 100 extends. Abutment bosses 120 (FIG. 8) are formed at the base of housing 118 and correspond to abutment bosses 48 of connectors 12 and 14.

Each connector 94 and 96 also includes a pair of cantilevered latch structures, generally designated 122 and 124, projecting from flange 98 at opposite ends of housing 118 at mounting end 116 of the connector. Generally, each latch structure includes base arm means projecting from mounting flange 98 and one locking arm deflectably cantilevered at one side of the base arm means from an end thereof remote from the mounting flange such that the locking arm extends angularly from the end of the base arm means and from the one side thereof back toward the mounting flange. The other side of the base arm means opposite the locking arm is substantially rigid.

More particularly, as seen best in FIG. 7, latch structure 122 includes a single base arm 126 projecting from mounting flange 98 with a locking arm 128 cantilevered therefrom and extending angularly from the distal end thereof back toward mounting flange 98. A substantially rigid post 130 is spaced laterally from base arm 126 at the end of the base arm means but is joined by a web 132 to the base arm near mounting flange 98.

The other latch structure 124 includes a single, substantially rigid base arm 134 seen best at the right-hand upper corner of connector 96 in FIG. 7. A locking arm 136 is seen best in the upper left-hand corner of connector 94 in FIG. 7. Locking arm 136 is cantilevered from the distal end of base arm 134 and extends angularly from the end of the base arm back toward mounting flange 98.

As with connectors 12 and 14 of panel mount system 10, panel mount system 92 includes means for polarizing connectors 94 and 96 relative to their respective panels 16 and 18. More particularly, the maximum cross-sectional dimension of each latch structure 122 and 124 is defined by locking arms 128 and 136 along with their respective base arm means. In other words, the maximum cross-sectional dimension of either latch structure is defined by the peripheral dimension about the free tips of the locking arms. Referring back to FIG. 7, along with FIG. 12, it clearly can be seen that the maximum cross-sectional dimension of latch structure 122, as defined by locking arm 128 and the spaced base arm 130, is greater than the maximum cross-sectional dimension of latch structure 124 as defined by locking arm 136 which is integral with base arm 134. Correspondingly, mounting portion 24 (FIG. 1) of mounting aperture 20 is larger than mounting portion 22 of the mounting aperture, and aperture portion 32 of mounting aperture 28 also is larger than mounting portion 30 of aperture 28. Therefore, larger latch structure 122 of connector 94 is alignable with larger mounting portion 24 of mounting aperture 20 in panel 16, and larger latch structure 122 of connector 96 is alignable with the end of aperture portion 32 of mounting aperture 28 in panel 18. Similarly, smaller latch structure 124 of connector 94 is alignment with smaller mounting portion 22 of mounting aperture 20 in panel 16, and smaller latch structure 124 of connector 96 is alignable with smaller mounting portion 30 of aperture 28 in panel 18.

Like panel mount system 10, panel mount system 92 includes a floating panel mount system for at least one of connectors 94 and/or 96. This would be true if either connector is inserted into aperture 20 of panel 16. In particular, enlarged aperture portion 26 of panel 16 is larger than the adjacent inserted portions (i.e. bosses 120) of either connector 94 or 96. Of course, as with connectors 12 and 14, it should be understood that the maximum cross-sectional dimension of the base arm means of latch structure 122 (i.e. base arm 126 and rigid post 130) is less than the respective adjacent portion of the mounting aperture within which the connector is mounted to provide a floating action within the aperture. Similarly, the maximum cross-sectional dimension of single base arm 134 of latch structure 124 is smaller than the respective adjacent portion of the mounting aperture within which the connector is mounted.

By providing a single deflectable locking arm 128 for each latch structure 122 and 124, the amount of twisting movement of either connector 94 or 96 in its respective aperture is minimized without affecting the amount of floating action of the connector within its aperture. In other words, rigid post 130 of latch structure 122 and rigid post 134 of latch structure 124 provide a substantially rigid structure on the side of the base arm means of the respective latch structure opposite the side from which the deflectable locking arm 128 or 136 is disposed. Not only is the amount of floating action unaffected, but polarization of either connector within its respective aperture is afforded.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A panel mount system for mounting an electrical connector in a mounting aperture in a panel, comprising:

said electrical connector including a mounting flange for interfacing with the panel, and a pair of cantilevered latch structures;

each latch structure including base arm means projecting from the mounting flange and one locking arm deflectably cantilevered at one side of the base arm means from an end of the base arm means remote from the mounting flange such that the locking arm extends angularly from the end of the base arm means and from said one side thereof back toward the mounting flange, the other side of the base arm means opposite the locking arm being substantially rigid, the base arm means of at least said one latch structure comprise a single base arm with the locking arm of the one latch structure being cantilevered therefrom and a substantially rigid post spaced from the base arm at said one end of the base arm means; and the maximum cross-sectional dimensions of one of the latch structures and its adjacent portion of the mounting aperture being different from the maximum cross-sectional dimensions of the other latch structure and its adjacent portion of the mounting aperture to provide polarization for the connector relative to the panel.

2. The panel mount system of claim 1 wherein said electrical connector comprises a first electrical connector, and including a second electrical connector mounted in an aperture in a second panel, the first and second electrical connectors being hermaphroditic.

3. The panel mount system of claim 1 wherein said single base arm is joined to the rigid post by a web near the mounting flange.

4. The panel mount system of claim 1 wherein the base arm means of the other latch structure comprise a single substantially rigid base arm with the locking arm of the other latch structure being cantilevered integrally therefrom.

5. The panel mount system of claim 1 wherein the base arm means of at least one of said latch structures comprise a single substantially rigid base arm with the locking arm thereof being cantilevered integrally therefrom.

6. The panel mount system of claim 1 wherein the dimensions of the base arm means of the latch structures adjacent the mounting flange are less than the adjacent portions of the mounting aperture to permit floating of the connector relative to the panel.

7. A panel mount system for mounting an electrical connector in a mounting aperture in a panel, comprising:

said electrical connector including a mounting flange for interfacing with the panel, and a pair of cantilevered latch structures; and each latch structure including base arm means projecting from the mounting flange and one locking arm deflectably cantilevered at one side of the base arm means from an end of the base arm means remote from the mounting flange such that the locking arm extends angularly from the end of the base arm means and from said one side thereof back toward the mounting flange, the other side of the base arm means opposite the locking arm being substantially rigid, the base arm means of at least said one latch structure comprise a single base arm with the locking arm of the one latch structure being cantilevered therefrom and a substantially rigid post spaced from the base arm at said one end of the base arm means.

8. The panel mount system of claim 7 wherein said single base arm is joined to the rigid post by a web near the mounting flange.

9. The panel mount system of claim 7 wherein the base arm means of the other latch structure comprise a single substantially rigid base arm with the locking arm of the other latch structure being cantilevered integrally therefrom.

10. The panel mount system of claim 7 wherein the base arm means of at least one of said latch structures comprise a single substantially rigid base arm with the locking arm thereof being cantilevered integrally therefrom.

11. The panel mount system of claim 7, including a guide post projecting from said mounting flange for guiding into a generally rectangular guide receptacle of a complementary connecting device, the guide post being X-shaped in cross-section defining intersecting legs with side edges of the legs being adapted for insertion into corners of the rectangular guide receptacle.

12. The panel mount system of claim 11 wherein the intersecting legs of said X-shaped guide post have end edges which taper to an apex at the end of the post.

* * * * *